US006274217B1

(12) United States Patent
Kim

(10) Patent No.: US 6,274,217 B1
(45) Date of Patent: Aug. 14, 2001

(54) BUFFER MEMBER FOR SHIPPING CARTON

(75) Inventor: Dong-jung Kim, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/178,651

(22) Filed: Oct. 26, 1998

(30) Foreign Application Priority Data

Dec. 2, 1997 (KR) ..... 97-65248

(51) Int. Cl.[7] ..... B32B 3/24; B65D 81/02

(52) U.S. Cl. ..... 428/131; 206/522; 206/523; 206/591; 428/138; 428/218

(58) Field of Search ..... 428/131, 138, 428/218; 206/522, 523, 591

(56) References Cited

U.S. PATENT DOCUMENTS 4,096,965 * 6/1978 Lessnig et al. ..... 220/20
4,572,716 * 2/1986 West ..... 410/36
4,851,286 * 7/1989 Maurice ..... 428/316.6
4,872,563 * 10/1989 Warder et al. ..... 206/634
4,911,962 * 3/1990 Baumann et al. ..... 428/363
5,160,021 * 11/1992 Sibley et al. ..... 206/204
5,322,181 * 6/1994 Nelson ..... 220/461
5,339,958 * 8/1994 Taravella et al. ..... 206/521
5,351,829 * 10/1994 Batsford ..... 206/522
5,628,402 * 5/1997 Dickie et al. ..... 206/521

FOREIGN PATENT DOCUMENTS 56-107366 8/1981 (JP) ..... B65D/81/06

* cited by examiner

*Primary Examiner*—William P. Watkins, III
(74) *Attorney, Agent, or Firm*—Sughrue, Mion, Zinn, Macpeak & Seas, PLLC

(57) ABSTRACT

A shipping protector for interposition between a shipping carton and an article being shipped for spacing the article within the carton, including a resilient buffer member and a buffer insert provided between the buffer member and the article.

5 Claims, 5 Drawing Sheets

BUFFER MEMBER FOR SHIPPING CARTON

BACKGROUND OF THE INVENTION

1. Field of the Invention

The present invention relates to a buffer member for a shipping carton, interposed between the shipping carton and an article packed within, to protect the packed article from external impact during shipping and storage.

2. Description of the Related Art

Home appliances including television sets, video cassette recorders, refrigerators and washing machines go through a packaging process during the final stage of manufacture.

As shown in FIG. 1 for descriptive purposes, a home appliance such as a television set 1 is generally packed in a shipping carton 10 usually constructed of corrugated cardboard, depending on the type and size of the appliance. Buffer members 11 and 12 are installed at the corners of the shipping carton 10 so that the television set 1 is prevented from moving inside the shipping carton 10. In addition to providing support, the buffer members protect the packed article by absorbing forces generated by an external impact to the shipping carton. In general, buffer members 11 and 12 are formed from a synthetic resin such as expanded polystyrene (EPS) or expanded polypropylene (EPP), often called Styrofoam.

In FIG. 1, reference numeral 11 indicates upper buffer members placed on the top/side portions of the television set 1 to protect the top and side surfaces of the television set 1. Reference numeral 12 indicates lower buffer members placed at the lower/side portions of the shipping carton 10 to protect the bottom and side surfaces of the television set 1.

As shown in FIG. 2, the interior surface 16 of the lower buffer member 12 is formed to correspond to the peripheral contours of certain portions of the packed article. Because of their placement along the bottom portion of the shipping carton 10 to support the packed article, the lower buffer members 12 can be crushed or damaged due to overload of the packed article, thereby reducing the buffer members support and cushioning attributes.

SUMMARY OF THE INVENTION

To limit potential crushing of the buffer members, and to offer increased protection to packed articles, it is an objective of the present invention to provide an improved buffer member for shipping cartons which effectively supports and cushions a packed article subject to static and dynamic overload conditions. To achieve this objective, there is provided a buffer member for a shipping carton, interposed between the shipping carton and a packed article which includes a buffer insert resistant to crushing caused by overload conditions.

The buffer insert is preferably fitted and fixed into an aperture formed along the inner surface of the buffer member. In addition, the buffer insert may comprise of a hollow cylindrical plug having a fluid filled inner cavity. According to another aspect of the present invention, the buffer insert comprises a cylindrical body formed from a plastic foam material having a density different from the buffer member.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
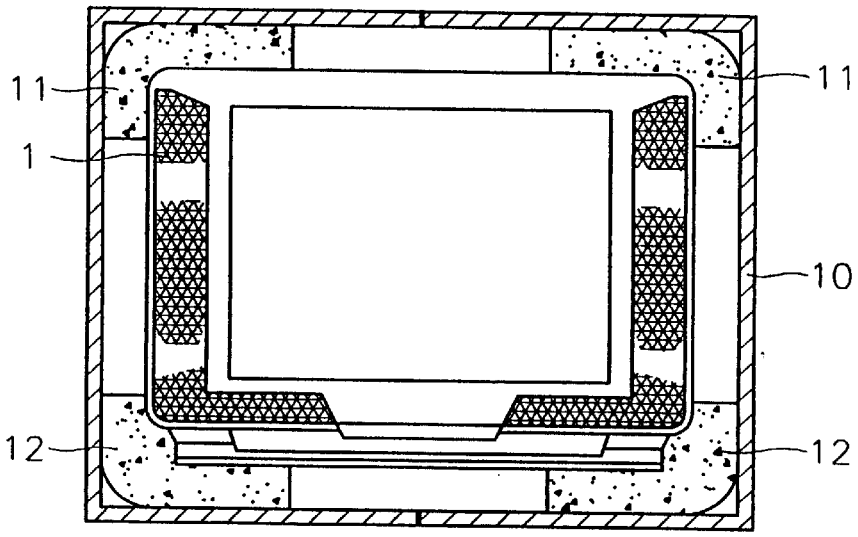
FIG.1 (PRIOR ART)
FIG. 1 is a vertical sectional view illustrating an example of a conventional shipping carton for a television set.
Figure 2:
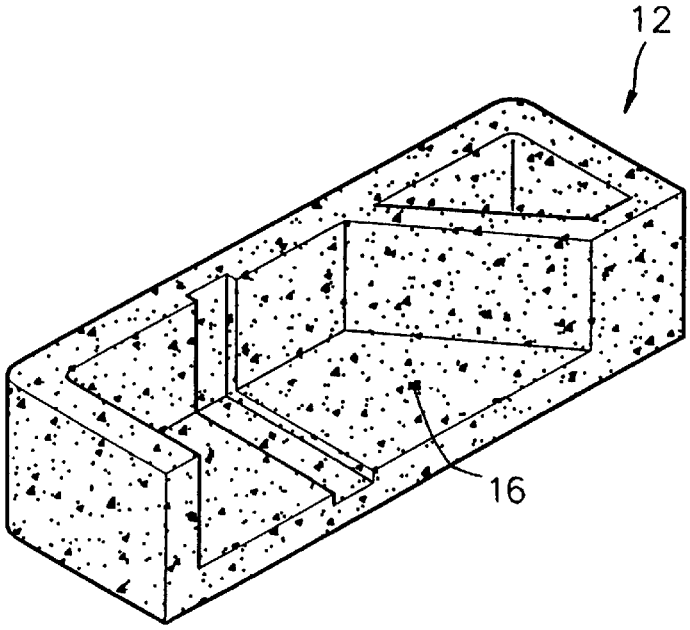
FIG.2 (PRIOR ART)
FIG. 2 is a perspective view illustrating the lower buffer member shown in FIG. 1.
Figure 3:
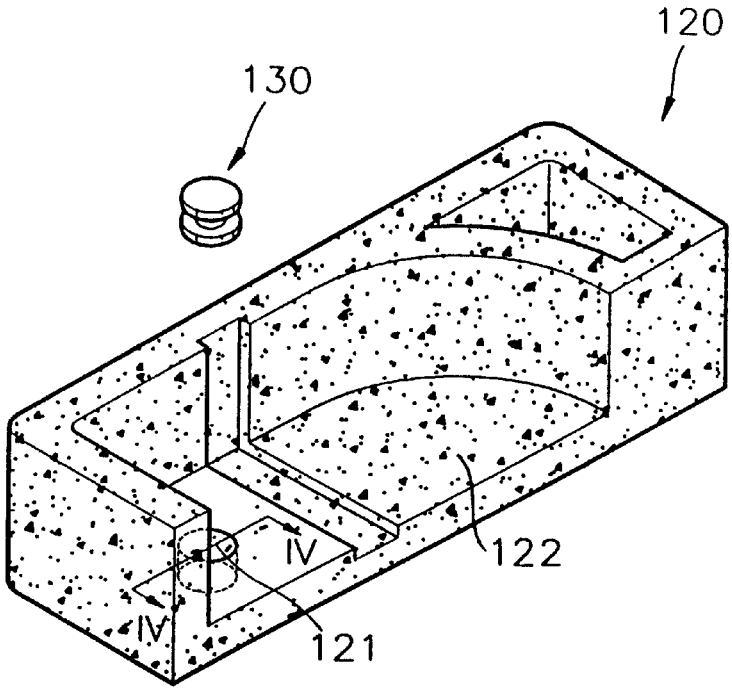
FIG. 3 is an exploded perspective view illustrating a buffer member for a shipping carton according to a preferred embodiment of the present invention.

Referring to FIG. 3, in a preferred embodiment of the present invention, a buffer member 120 for a shipping carton is formed from a synthetic resin such as expanded polystyrene (EPS) or expanded polypropylene (EPP), often called Styrofoam, to correspond to certain peripheral contours of a packed article. An aperture 121 is formed along the interior surface 122 of the buffer member 120, and a buffer insert 130 is fitted and fixed into the aperture 121.

Figure 4:
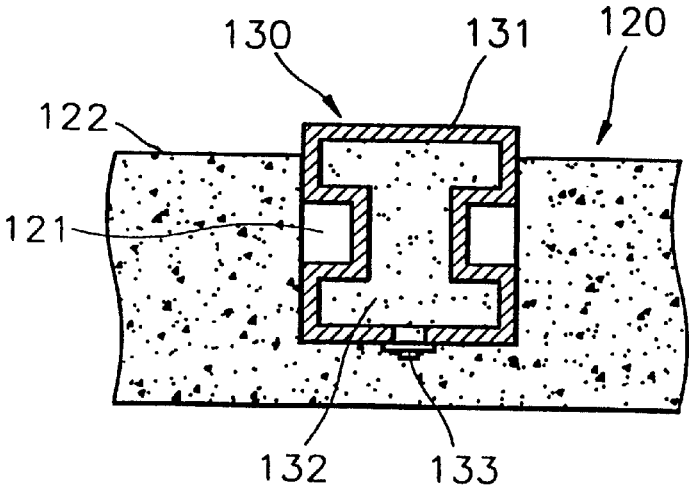
FIG. 4 is a sectional view taken along line IV—IV of FIG. 3.
Figure 9:
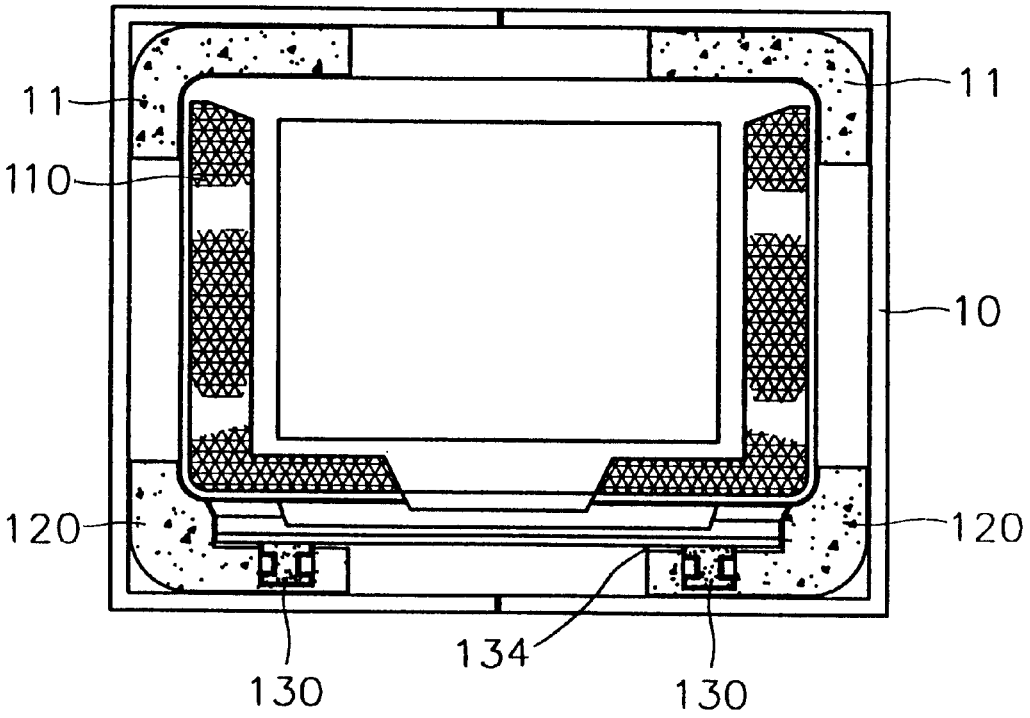
FIG. 9 is a vertical sectional view illustrating a package for a television set using the buffer member for a shipping carton shown in FIG. 3.

As shown in FIG. 4, the buffer insert 130 is a hollow plug 131, formed from an elastic material such as rubber or synthetic resin, containing an internal cavity filled with a fluid such as air or oil. The height of the buffer insert 130 is greater than the depth of aperture 121, such that the upper portion of the buffer insert 130 protrudes above the interior surface 122 of the buffer member 120 by a predetermined height. Accordingly, as shown in FIG. 9, a buffering gap 134 is formed between the bottom surface of a packed article 110 and the buffer member 120. Improved support and cushioning of the packaged article is provided since pressure on a portion of the buffer member 120 where the load of the packed article is concentrated, is effectively absorbed by the buffer insert 130.

A valve 133 may be installed to regulate the amount of fluid 132 contained in the internal cavity of hollow plug 131. Regulating the amount of fluid 132 according to the type or size of the packed article optimizes the buffer insert's support and cushioning attributes.

The buffer insert 130 according to the present invention is not limited by the shape or the structure shown in FIGS. 3 and 4. Namely, various shapes or structures, e.g., a square-section tube or triangular-section tube can be adopted for the buffer insert 130. In addition, the buffer insert 130 may be positioned along the exterior surface of the buffer member 120.

Figure 5:
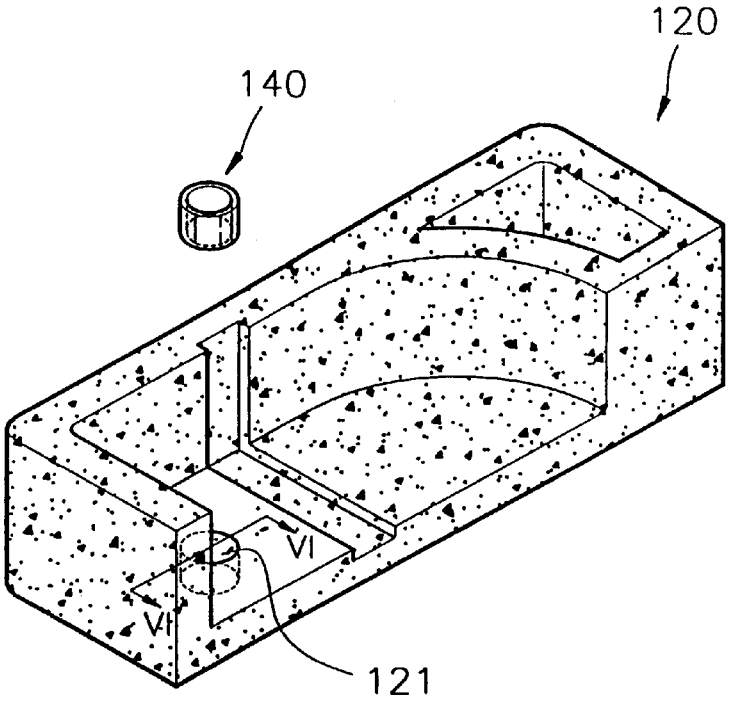
FIG. 5 is an exploded perspective view illustrating a buffer member for a shipping carton according to another preferred embodiment of the present invention.
Figure 6:
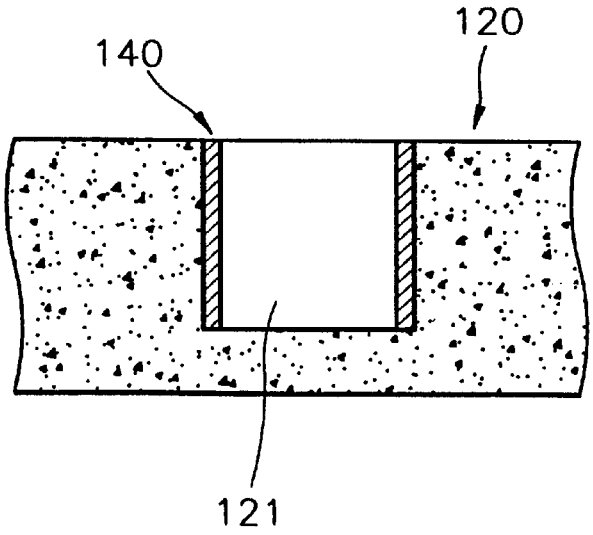
FIG. 6 is a sectional view taken along line VI—VI of FIG. 5.

As shown in FIGS. 5 and 6, for example, the buffer insert 140 can be an open cylindrical body made of corrugated cardboard, rubber or synthetic resin to form an elastic member for insertion into aperture 121.

Figure 7:
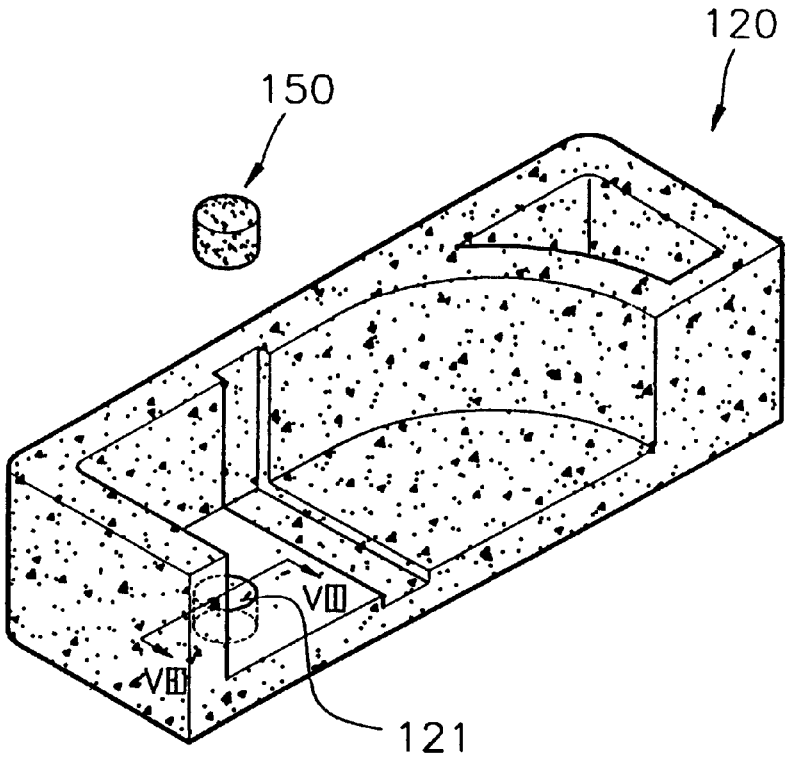
FIG. 7 is an exploded perspective view illustrating a buffer member for a shipping carton according to yet another preferred embodiment of the present invention.
Figure 8:
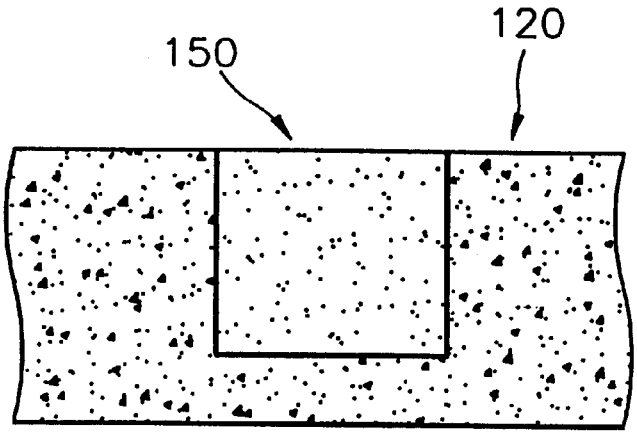
FIG. 8 is a sectional view taken along line VIII—VIII of FIG. 7.

Referring to FIGS. 7 and 8, the buffer insert 150 may also be formed from a material having a different density from the buffer member 120. For example, the buffer insert 150 is formed from a synthetic resin foam such as expanded polystyrene or expanded polypropylene, having a density different from the buffer member 120. The buffer insert 150 is fitted into aperture 121.

Although each of the buffer inserts 140 and 150 shown in FIGS. 5 through 8 is formed to have a height equal to the depth of aperture 121, so that the top surfaces of the buffer inserts 140 and 150 are flush with the inner surface 122 of the buffer member 120, the buffer inserts 140 and 150 can also be formed to have heights greater than the depth of aperture 121, as shown in FIG. 4, so that the upper surfaces of the buffer inserts 140 and 150 protrude above the inner surface of the buffer member 120 by a predetermined height. The embodiments disclosed in FIGS. 5 through 8 are simple to manufacture since the buffer inserts 140 and 150 do not include fluid filled internal cavities.

As described above, the buffer member for a shipping carton according to the present invention can effectively absorb forces directed at a portion of a packed article at or along an area where the weight of the article is concentrated. This improves the support and cushioning of packed articles over prior buffering methods.

It is conceivable that numerous modifications may be made to the buffer member for shipping carton of the present invention without departing from the spirit and scope of the invention as defined in the following claims.

What is claimed is:

1. A shipping protector for interposition between a shipping carton and an article being shipped for spacing said article within the shipping carton, comprising:

a buffer member having an exterior surface, an interior surface for contacting at least a portion of a peripheral surface of said article, and at least one intermediate surface between said exterior surface and said interior surface; and at least one buffer insert having a contact end portion and a free end portion, wherein said at least one buffer insert is disposed along at least one of the interior surface and the exterior surface of said buffer member, wherein at least one aperture is provided in at least one of the interior surface and the exterior surface of said buffer member and said buffer insert is fitted and fixed within said aperture; and wherein said buffer insert is an open cylindrical body.

2. A shipping protector for interposition between a shipping carton and an article being shipped for spacing said article within the shipping carton, comprising:

a buffer member having an exterior surface, an interior surface for contacting at least a portion of a peripheral surface of said article, and at least one intermediate surface between said exterior surface and said interior surface; and at least one buffer insert having a contact end portion and a free end portion, wherein said at least one buffer insert is disposed along at least one of the interior surface and the exterior surface of said buffer member;

wherein at least one aperture is provided in at least one of the interior surface and the exterior surface of said buffer member and said buffer insert is fitted and fixed within said aperture;

wherein said buffer member is formed from a first resilient material; and wherein said buffer insert is an open cylindrical body.

3. The shipping protector according to claim 2, wherein said buffer insert is formed from a second resilient material.

4. The shipping protector according to claim 1, wherein said buffer insert is formed from a material having a density different from said buffer member.

5. The shipping protector according to claim 2, wherein said buffer insert is formed from a material having a density different from said buffer member.

* * * * *